US008137216B2

(12) United States Patent
Sullivan et al.

(10) Patent No.: US 8,137,216 B2
(45) Date of Patent: Mar. 20, 2012

(54) GOLF BALL SURFACE PATTERNS COMPRISING MULTIPLE CHANNELS

(75) Inventors: Michael J. Sullivan, Barrington, RI (US); Steven Aoyama, Marion, MA (US); Edmund A. Hebert, Mattapoisett, MA (US)

(73) Assignee: Acushnet Company, Fairhaven, MA (US)

( * ) Notice: Subject to any disclaimer, the term of this patent is extended or adjusted under 35 U.S.C. 154(b) by 137 days.

(21) Appl. No.: 12/233,649

(22) Filed: Sep. 19, 2008

(65) Prior Publication Data

US 2009/0017941 A1 Jan. 15, 2009

Related U.S. Application Data

(60) Continuation-in-part of application No. 12/061,779, filed on Apr. 3, 2008, and a continuation-in-part of application No. 11/025,952, filed on Jan. 3, 2005, now Pat. No. 7,588,505, which is a continuation-in-part of application No. 11/141,093, filed on May 31, 2005, now Pat. No. 7,455,601, which is a division of application No. 10/077,090, filed on Feb. 15, 2002, now Pat. No. 6,905,426.

(51) Int. Cl.
*A63B 37/12* (2006.01)

(52) U.S. Cl. ..... 473/383
(58) Field of Classification Search ..... 473/378–385
See application file for complete search history.

(56) References Cited

U.S. PATENT DOCUMENTS

| | | | | | |
|---|---|---|---|---|---|
| 922,773 | A | * | 5/1909 | Kempshall | 473/383 |
| 2,135,210 | A | * | 11/1938 | Farrar | 473/383 |
| 4,284,276 | A | * | 8/1981 | Worst | 473/383 |
| 4,616,828 | A | * | 10/1986 | Haythornthwaite | 473/606 |
| 4,830,378 | A | | 5/1989 | Aoyama | |
| 5,547,197 | A | * | 8/1996 | Pocklington | 473/384 |
| 5,879,245 | A | * | 3/1999 | Hwang | 473/384 |
| 6,475,105 | B1 | | 11/2002 | Murphy | |
| 6,632,150 | B1 | | 10/2003 | Ogg | |
| 2002/0025864 | A1 | * | 2/2002 | Barfield | 473/378 |
| 2004/0005937 | A1 | * | 1/2004 | Saiz | 473/351 |
| 2004/0224042 | A1 | * | 11/2004 | Tzivanis et al. | 425/116 |
| 2006/0281583 | A1 | * | 12/2006 | Sato et al. | 473/351 |
| 2007/0026971 | A1 | * | 2/2007 | Aoyama et al. | 473/378 |

* cited by examiner

*Primary Examiner* — Raeann Gorden
(74) *Attorney, Agent, or Firm* — Mandi B. Milbank

(57) ABSTRACT

A golf ball having an improved surface pattern is disclosed. The golf ball has one or more channels or ridges on its surface. These ridges or channels may decrease drag, or may increase lift, and may increase or decrease flight symmetry. These channels or ridges may be linear, or may be curved, and may or may not fully circumscribe the golf ball. These channels or ridges may also be combined with traditional or non-traditional dimples.

17 Claims, 20 Drawing Sheets

GOLF BALL SURFACE PATTERNS COMPRISING MULTIPLE CHANNELS

REFERENCE TO RELATED PATENT APPLICATIONS

This application is a continuation-in-part of U.S. patent application Ser. No. 11/025,952, filed on Jan. 3, 2005 now U.S. Pat. No. 7,588,505 and published under U.S. Patent Application Publication No. 2006/0148591 A1 on Jul. 6, 2006, which is incorporated by reference herein in its entirety.

This application is also a continuation-in-part of U.S. patent application Ser. No. 12/061,779, filed on Apr. 3, 2008, which is a continuation-in-part of U.S. patent application Ser. No. 11/141,093, filed on May 31, 2005 now U.S. Pat. No. 7,455,601 and published under U.S. Patent Application Publication No. 2005/0221916 A1 on Oct. 6, 2005, which is a divisional of U.S. patent application Ser. No. 10/077,090 filed on Feb. 15, 2002 and patented as U.S. Pat. No. 6,905,426 B2 on Jun. 14, 2005. U.S. patent application Ser. Nos. 12/061,779 and 11/141,093 and U.S. Pat. No. 6,905,426 are incorporated by reference herein in their entireties.

FIELD OF THE INVENTION

The present invention relates to golf balls, and more particularly, to golf balls having improved surface patterns. More specifically, the present invention relates to golf balls having ridges or channels on the golf ball surface.

BACKGROUND OF THE INVENTION

Golf balls generally include a spherical outer surface with a plurality of dimples formed thereon. Conventional dimples are circular depressions that reduce drag and increase lift. These dimples are formed where a dimple wall slopes away from the outer surface of the ball forming the depression.

Drag is the air resistance that opposes the golf ball's flight direction. As the ball travels through the air, the air that surrounds the ball has different velocities, thus different pressures. The air exerts maximum pressure at a stagnation point on the front of the ball. The air then flows around the surface of the ball with an increased velocity and reduced pressure. At some separation point, the air separates from the surface of the ball and generates a large turbulent flow area behind the ball. This flow area, which is called the wake, has low pressure. The difference between the high pressure in front of the ball and the low pressure behind the ball slows the ball down. This is the primary source of drag for golf balls.

The dimples on a traditional golf ball cause a thin boundary layer of air adjacent to the ball's outer surface to flow in a turbulent manner. Thus, the thin boundary layer is called a turbulent boundary layer. The turbulence energizes the boundary layer and helps move the separation point further backward, so that the boundary layer stays attached further along the ball's outer surface. As a result, there is a reduction in the area of the wake, an increase in the pressure behind the ball, and a substantial reduction in drag. It is the circumference of each dimple, where the dimple wall drops away from the outer surface of the ball, which allows dimples to create the turbulence in the boundary layer.

Lift is an upward force on the ball that is created by a difference in pressure between the top of the ball and the bottom of the ball. This difference in pressure is created by a warp in the airflow that results from the ball's backspin. Due to the backspin, the top of the ball moves with the airflow, which delays the air separation point to a location further backward. Conversely, the bottom of the ball moves against the airflow, which moves the separation point forward. This asymmetrical separation creates an arch in the flow pattern that requires the air that flows over the top of the ball to move faster than the air that flows along the bottom of the ball. As a result, the air above the ball is at a lower pressure than the air underneath the ball. This pressure difference results in the overall force, called lift, which is exerted upwardly on the ball. The circumference of each dimple is important in optimizing this flow phenomenon, as well.

By using dimples to decrease drag and increase lift, almost every golf ball manufacturer has increased their golf ball flight distances. In order to improve ball performance, it is desirable to have a large number of dimples, hence a large amount of dimple circumference. In arranging the dimples, an attempt is made to minimize the space between dimples, because such space does not improve aerodynamic performance of the ball. In practical terms, this usually translates into 300 to 500 circular dimples with a conventional sized dimple having a diameter that typically ranges from about 0.100 inches to about 0.180 inches.

When compared to one conventional size dimple, theoretically, an increased number of small dimples will create greater aerodynamic performance by increasing total dimple circumference. However, in reality small dimples are not always very effective in decreasing drag and increasing lift. This results at least in part from the susceptibility of small dimples to paint flooding. Paint flooding occurs when the paint coat on the golf ball fills the small dimples, and consequently decreases the dimple's aerodynamic effectiveness.

Golf ball manufacturers continue to search for more efficient methods of changing the surface of a golf ball in order to improve the aerodynamics or to impart unique aerodynamic properties to golf balls.

SUMMARY OF THE INVENTION

The present invention is directed to a golf ball with improved surface patterns. More specifically, the present invention relates to golf balls having a system of ridges or channels on the golf ball surface. Preferably, the edge angle of the ridges or channels is more than about 16°, preferably more than about 18°, and more preferably more than about 20°.

The present invention is further directed to a golf ball comprising a substantially spherical outer surface and a channel system comprising one or more channels formed thereon. The channels of the present invention may be straight or curved, may or may not circumscribe the golf ball. The channels may or may not intersect other channels. Preferably, the surface coverage of the channels is less than about 40%, preferably less than about 30%, or less than about 20% or less than about 10%.

In some embodiments, these channels may allow the golf ball to have orientation-specific aerodynamic properties, i.e., to fly differently depending on its orientation when hit off of a tee. In other embodiments, the channels allow the ball to have greater flight symmetry. In some embodiments, there may be both channels and dimples or other features on the surface of the golf ball.

BRIEF DESCRIPTION OF THE DRAWINGS

Further features and advantages of the invention can be ascertained from the following detailed description that is provided in connection with the drawings described below.

DETAILED DESCRIPTION

Figure 13A:
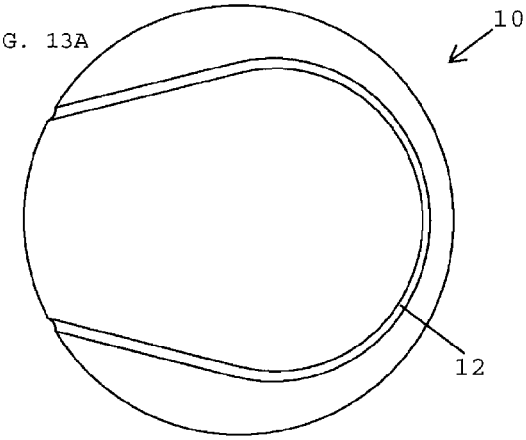
Figure 13B:
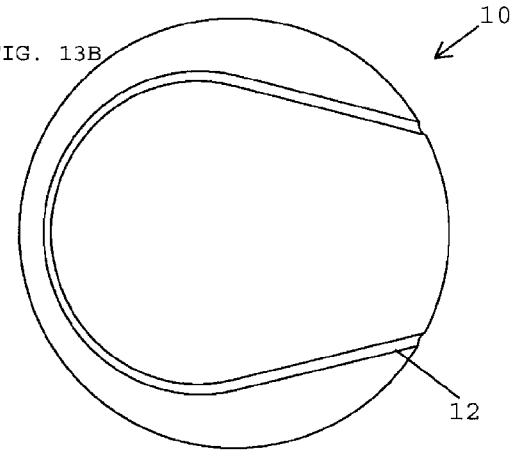
Figure 13C:
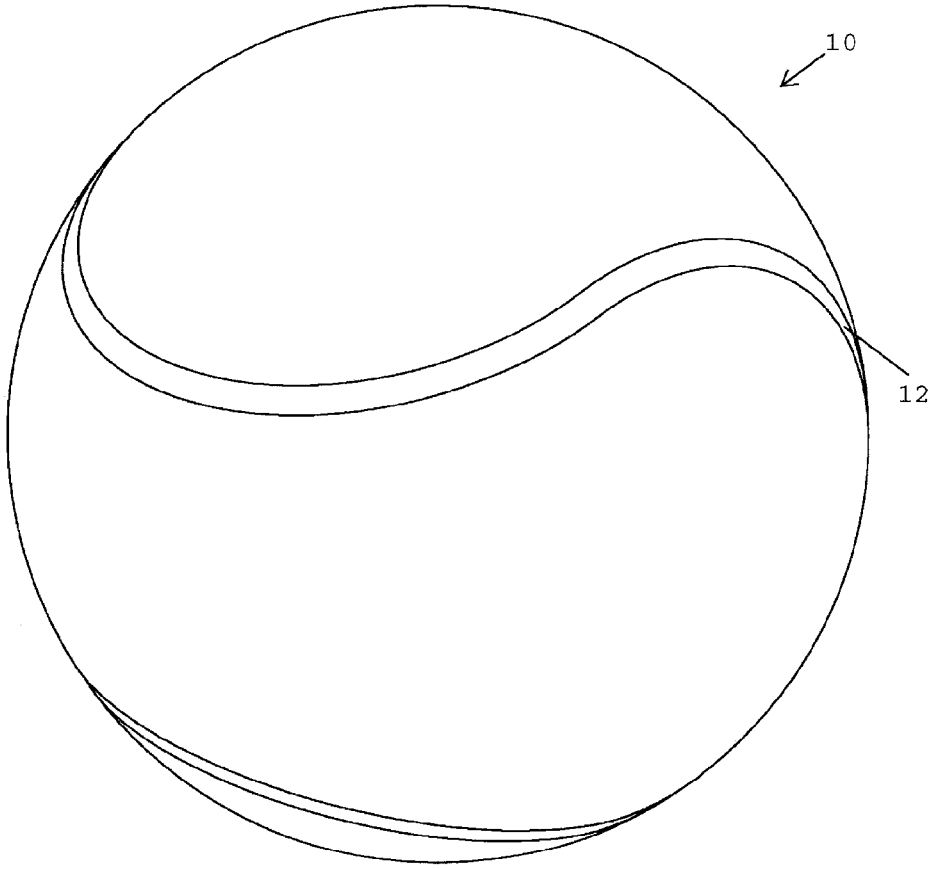

In one embodiment as illustrated in FIGS. 1-19, the present invention comprises a golf ball 10 having a channel system comprising one or more surface channels 12 to improve the ball's aerodynamics. Channels 12 may have any desired shape or pattern. This may include, but is not limited to, geometric patterns, fractal patterns, irregular patterns, linear and non-linear lines, and the like. In one embodiment, it may be desirable for the pattern to be a combination of at least two of geometric patterns, fractal patterns, irregular patterns, and lines. Golf ball 10 may have a single channel 12 that transcribes the ball as illustrated in FIGS. 13 and 14 or may comprise multiple intersecting or non-intersecting channels. Channels 12 may have any shape, including, but not limited to linear, circular, oval, arcuate, sinusoid, irregular, or combinations thereof. Channels of the present invention may also have any of a variety of cross-sectional shapes, including, but not limited to, semicircular, parabolic, hyperbolic, polygonal, catenary, or irregular.

Preferably, channels 12 have an edge angle that is steeper than edge angles for conventional circular dimples. In one example, channels 12 have substantially the same depth as conventional circular dimples, but have a width that is significantly less than the diameter of conventional circular dimples, causing the edge angle to be steeper than the edge angle of conventional circular dimples, which typically ranges from 12°-16°. The edge angle of channels 12 is preferably greater than about 16°, more preferably greater than about 18°, and more preferably greater than about 20°. The edge angle can range from about 16° to about 90°, preferably from about 18° to about 40°, and more preferably from about 20° to about 30°.

Figure 20:
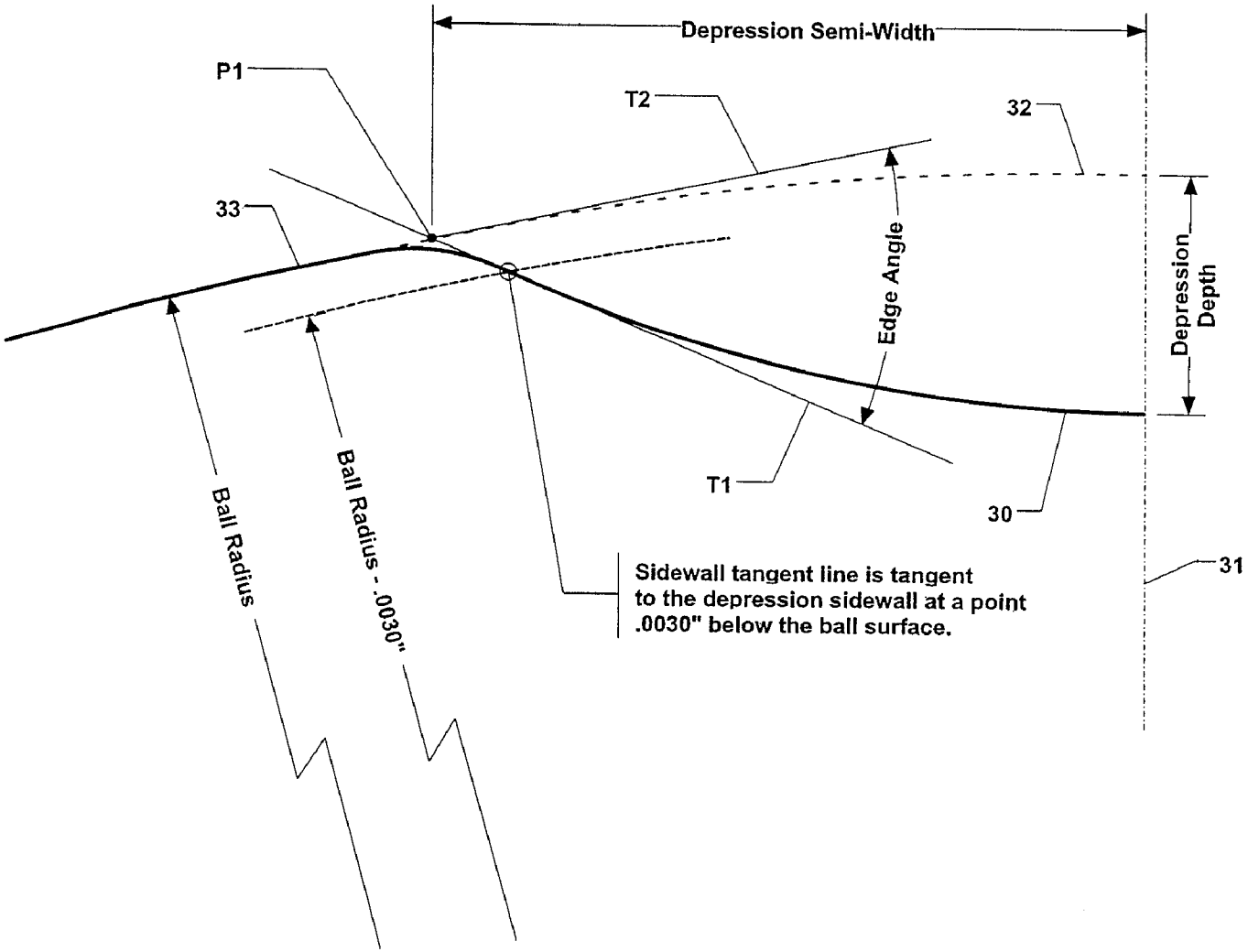
FIG. 20 is a diagram showing a preferred way to measure the edge angle of a dimple or a channel.

Generally, it may be difficult to define and measure an edge angle of a depression such as a dimple or a channel on a golf ball due to the indistinct nature of the boundary dividing the depression from the ball's undisturbed land surface. FIG. 20 shows a semi-profile 30 taken perpendicularly across channel or depression 12, extending from the depression's centerline 31 (positioned at the deepest point of the profile and passing through the ball's center point) to land surface 33 outside of the depression. Due to the effects of the paint and/or the depression design itself, the junction between the land surface and the depression sidewall is not a sharp corner and is therefore indistinct. This can make the measurement of a depression's edge angle and width somewhat ambiguous. To resolve this problem, the ball phantom surface 32 is constructed above the depression as a continuation of land surface 33. A first tangent line T1 is then constructed at a point on the sidewall that is spaced about 0.003 inches radially inward from the phantom surface 32. T1 intersects phantom surface 32 at a point P1, which defines a nominal edge position. A second tangent line T2 is then constructed, tangent to the phantom surface 32, at P1. The edge angle is the angle between T1 and T2. If the depression profile is not symmetrical across the centerline 31, then the width of depression 12 is the distance between P1 and its equivalent point directly opposite therefrom. Alternatively, if the profile is symmetrical across the centerline 31, then the width is twice the distance between P1 and the centerline 31, measured in a direction perpendicular to centerline 31.

Figure 1A:
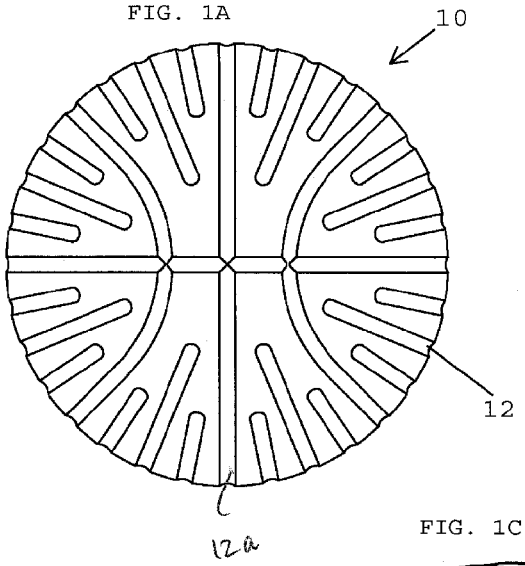
FIGS. 1-19 show exemplary channel patterns for golf balls of the present invention, and Figures with the suffix "A" denote front views and Figures with the suffix "B" denote rear views.
Figure 1B:
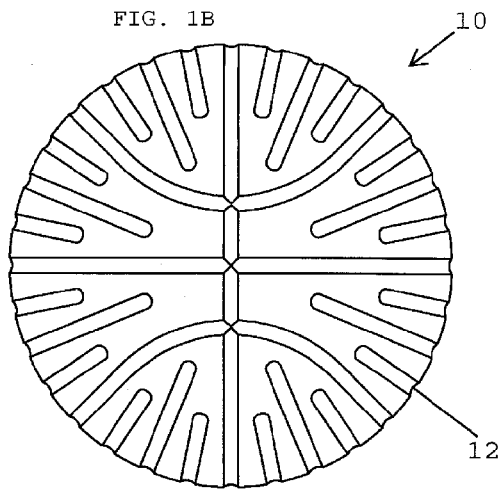
Figure 1C:
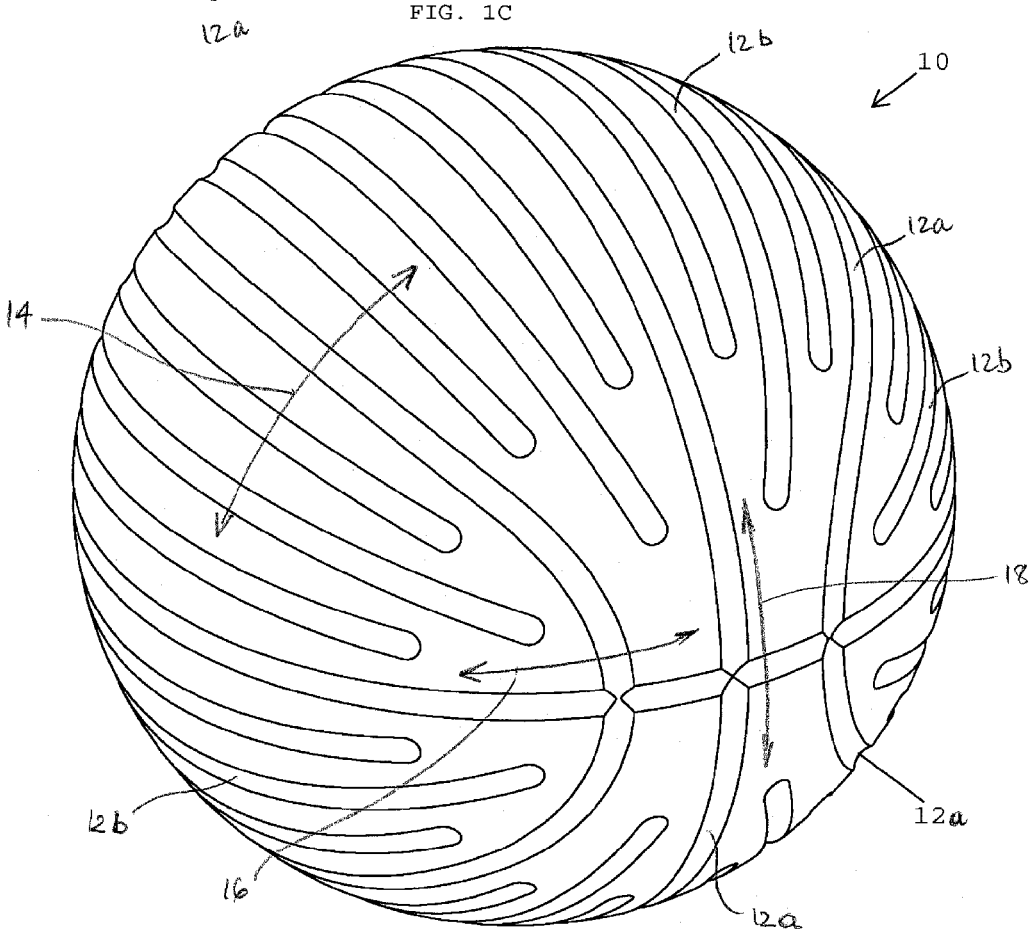
Figure 14A:
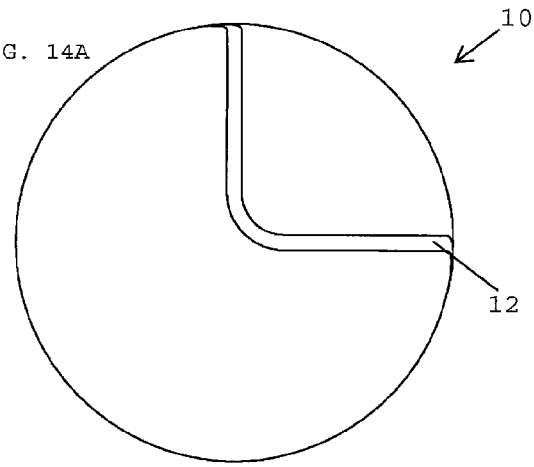
Figure 14B:
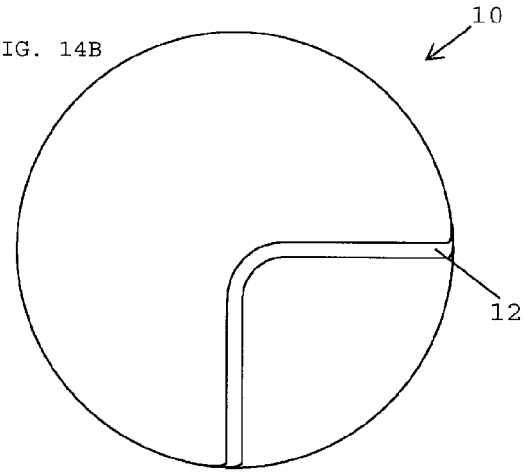
Figure 14C:
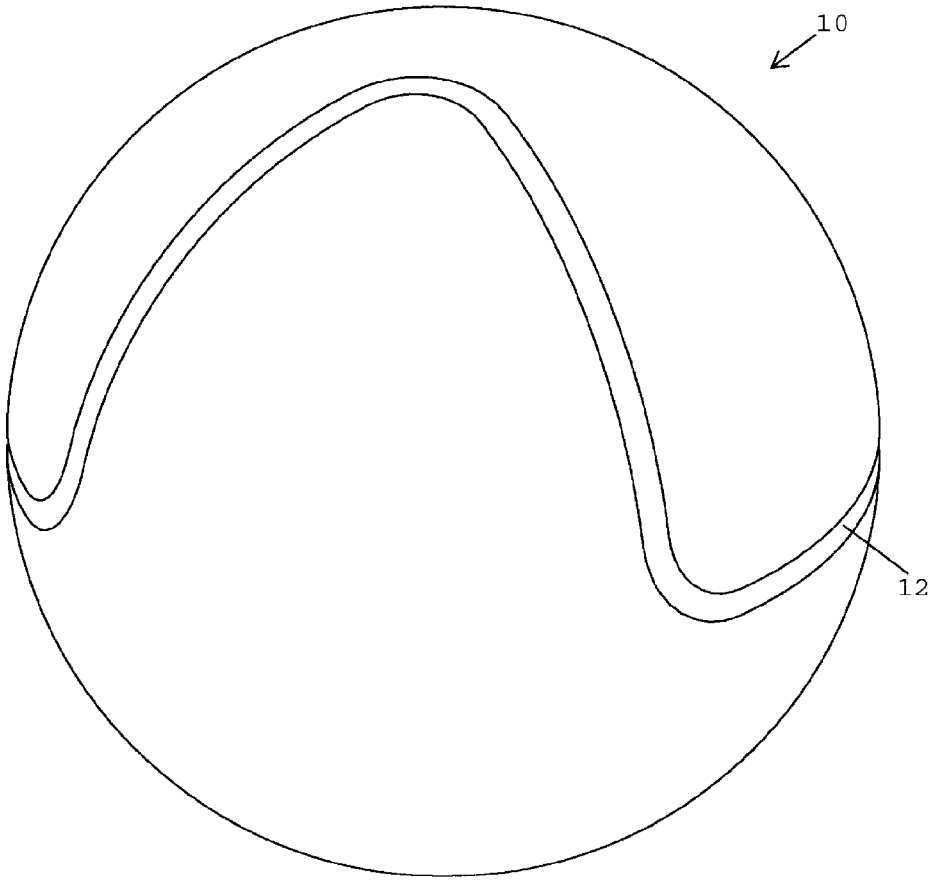
Figure 15:
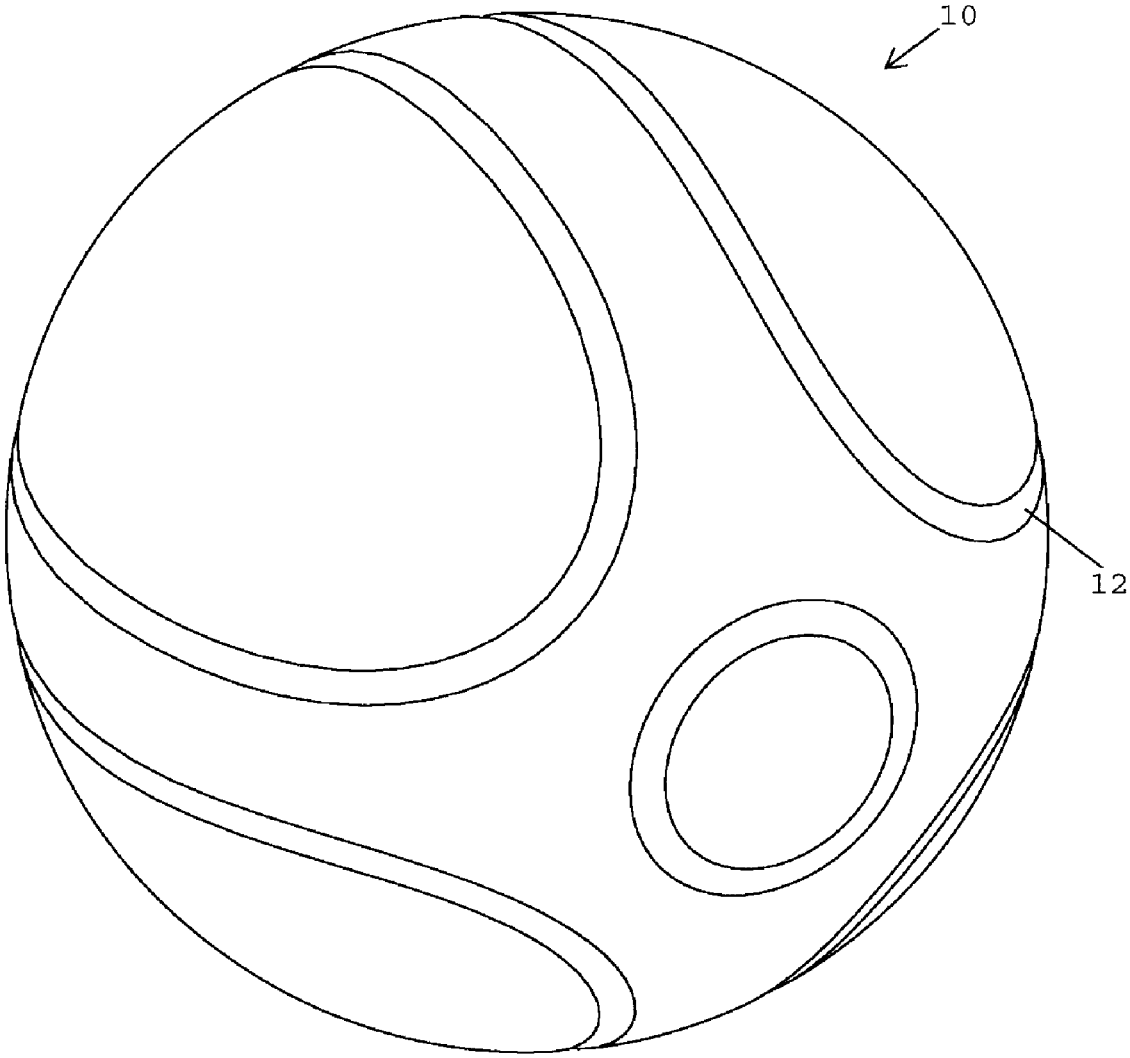
Figure 16:
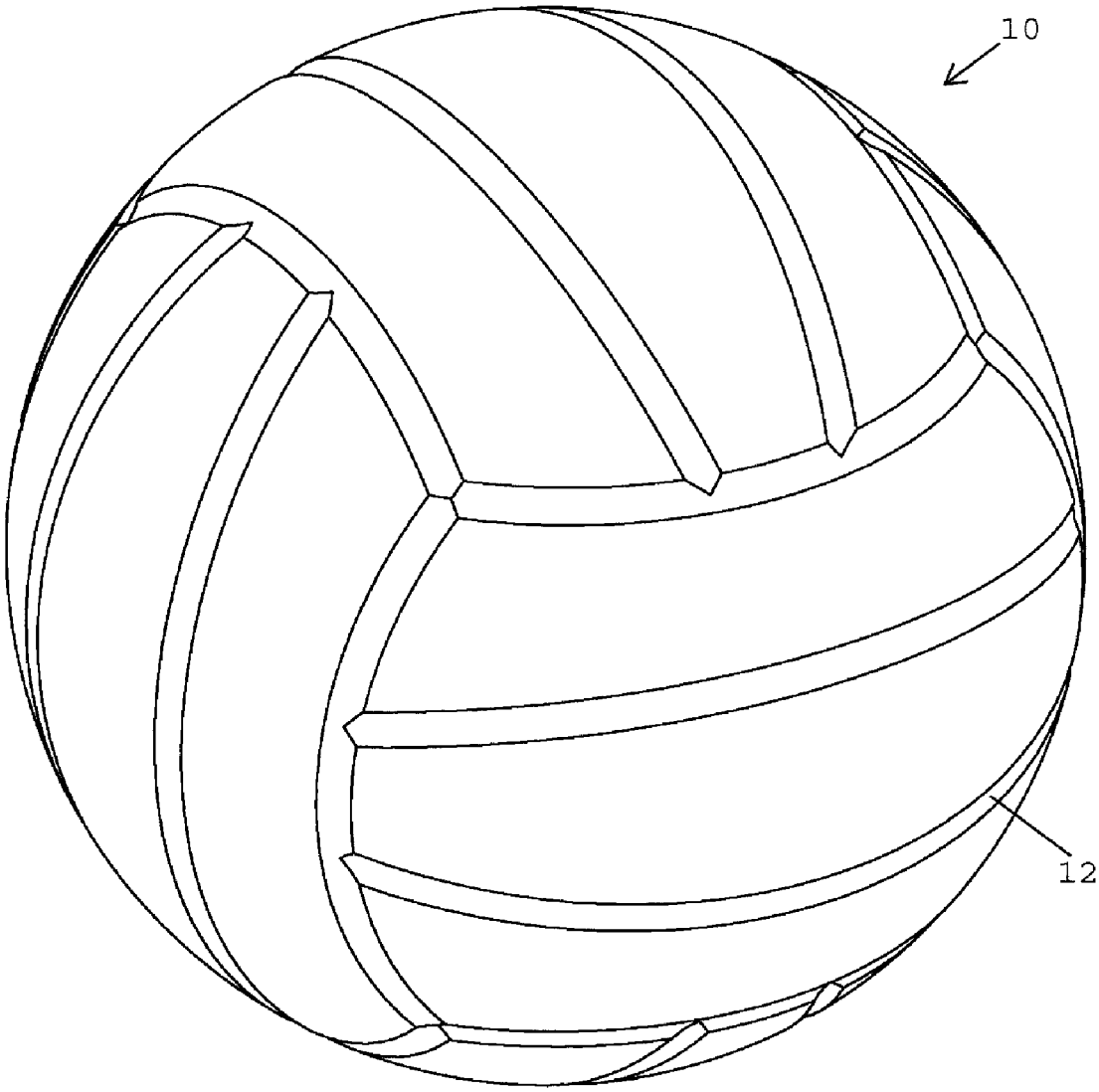

Referring to FIGS. 1A-1C, ball 10 has a channel system comprising interconnecting channels 12*a* and non-connecting channels 12*b* (collectively channels 12). In this embodiment, channels 12 comprise about 37.4% of the land surface. As shown in FIGS. 14A-C, channel 12 comprises about 5.1% of the land area. Channels 12 may comprise a large percentage of the land surface, but in accordance with one aspect of the present invention, they preferably comprise about 40% or less of the land surface, more preferably about 30% or less, about 20% or less or about 10% or less. The combination of a relatively low coverage of the land surface, i.e., about 40% or less, and relatively steep edge angle, i.e., about 16° or more, provides a unique aerodynamic package for golf ball 10 of the present invention that cannot be achieved with conventional circular dimples alone.

One advantage of having relatively low surface coverage is that golf ball 10 behaves more like a true sphere and less like a faceted object when putting. This would result in a truer direction of departure from the putter face, and a truer roll along the ground. This would be advantageous to all golfers, but especially to highly skilled golfers who will enjoy the full benefit of their putting skills because of the reduced influence of randomness.

In one example, as shown in FIG. 1, channels 12 provide ball 10 with unique orientation-specific aerodynamic properties. Ball 10 can be orientated at tee-off with arrow 14, 16, or 18 at the top of ball 10 and pointed along the target line. When ball 10 is struck along arrow 14, it will have back spin in the direction of arrow 14. The airflow over ball 10 would flow across the most channels 12 in this embodiment resulting in the most lift and causing the ball to have a relatively high trajectory and greater carry distance. The roll distance would be relatively short not only because of the high trajectory, but also because of extra traction provided by the groove orientation as the backspinning ball impacts the ground. When ball 10 is struck along arrows 16 or 18, the airflow over the ball would flow along a plurality of channels 12 and across a smaller number of channels 12, resulting in less lift and causing the ball to have a shallower trajectory and less carry distance. Roll distance would be longer, not only because of the low trajectory but also because of reduced traction provided by the groove orientation as the backspinning ball impacts the ground. This embodiment is expected to have at least one and preferably at least two different orientations, e.g., 14 and 16 producing a peak trajectory height difference of at least 10% when compared to a third orientation, e.g. 18, when launched at an initial speed of about 235 ft/sec, a launch angle of about 9.5°, and a backspin rate of about 3,000 rpm. The orientation specific aerodynamic properties are applicable to balls with channels 12 only and to balls with channels 12 and dimples.

Figure 2:
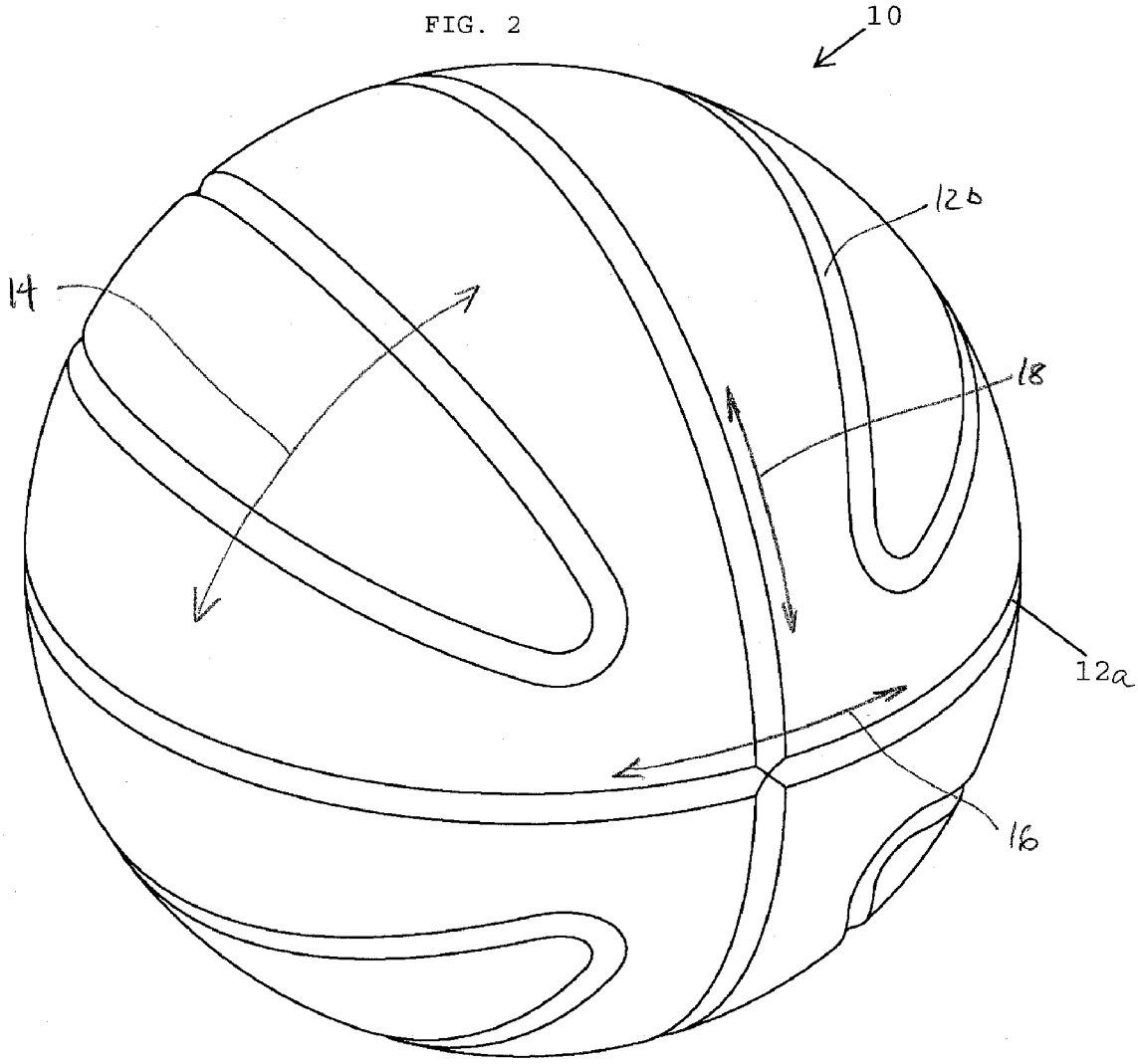
Figure 3A:
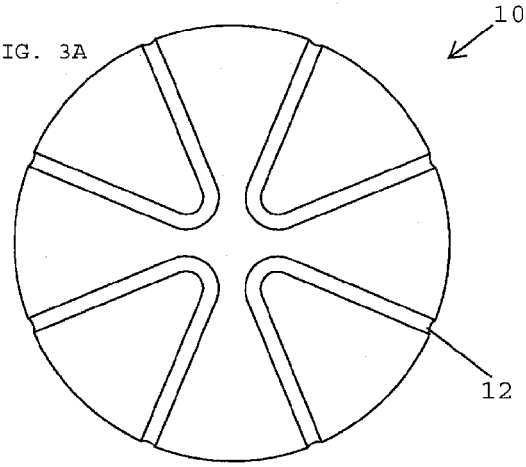
Figure 3B:
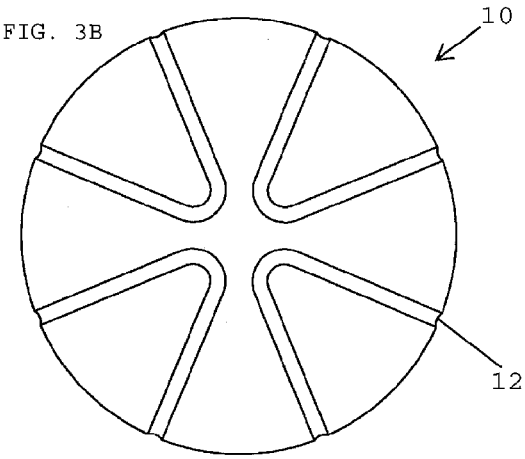
Figure 3C:
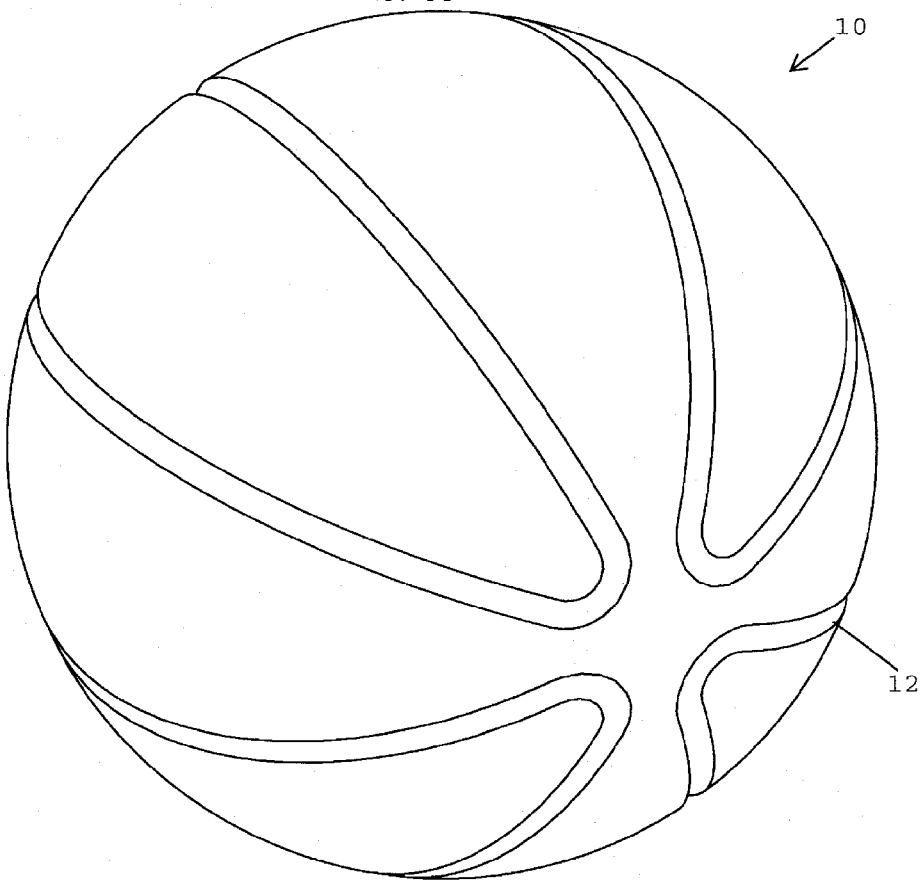
Figure 4:
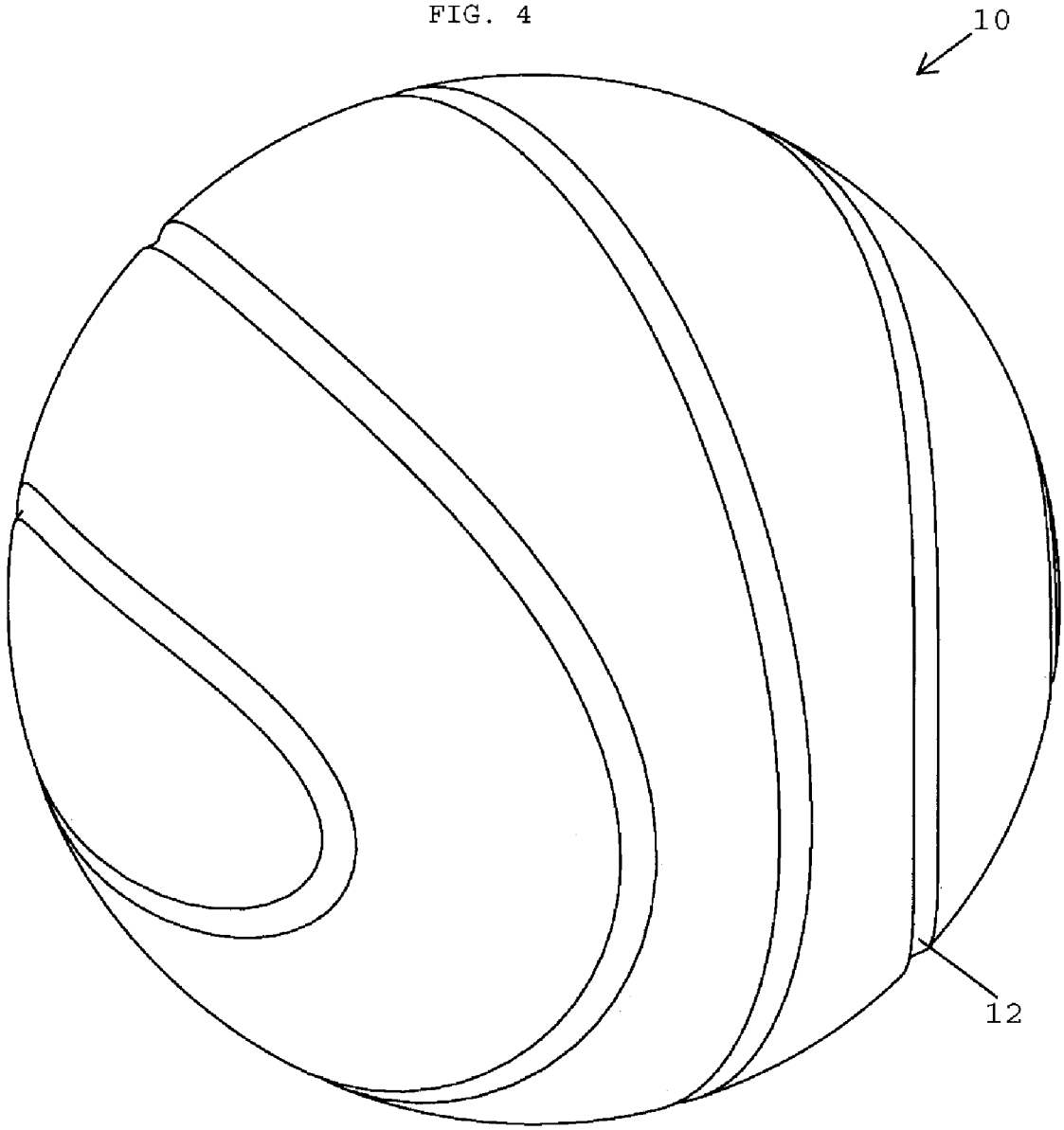
Figure 5:
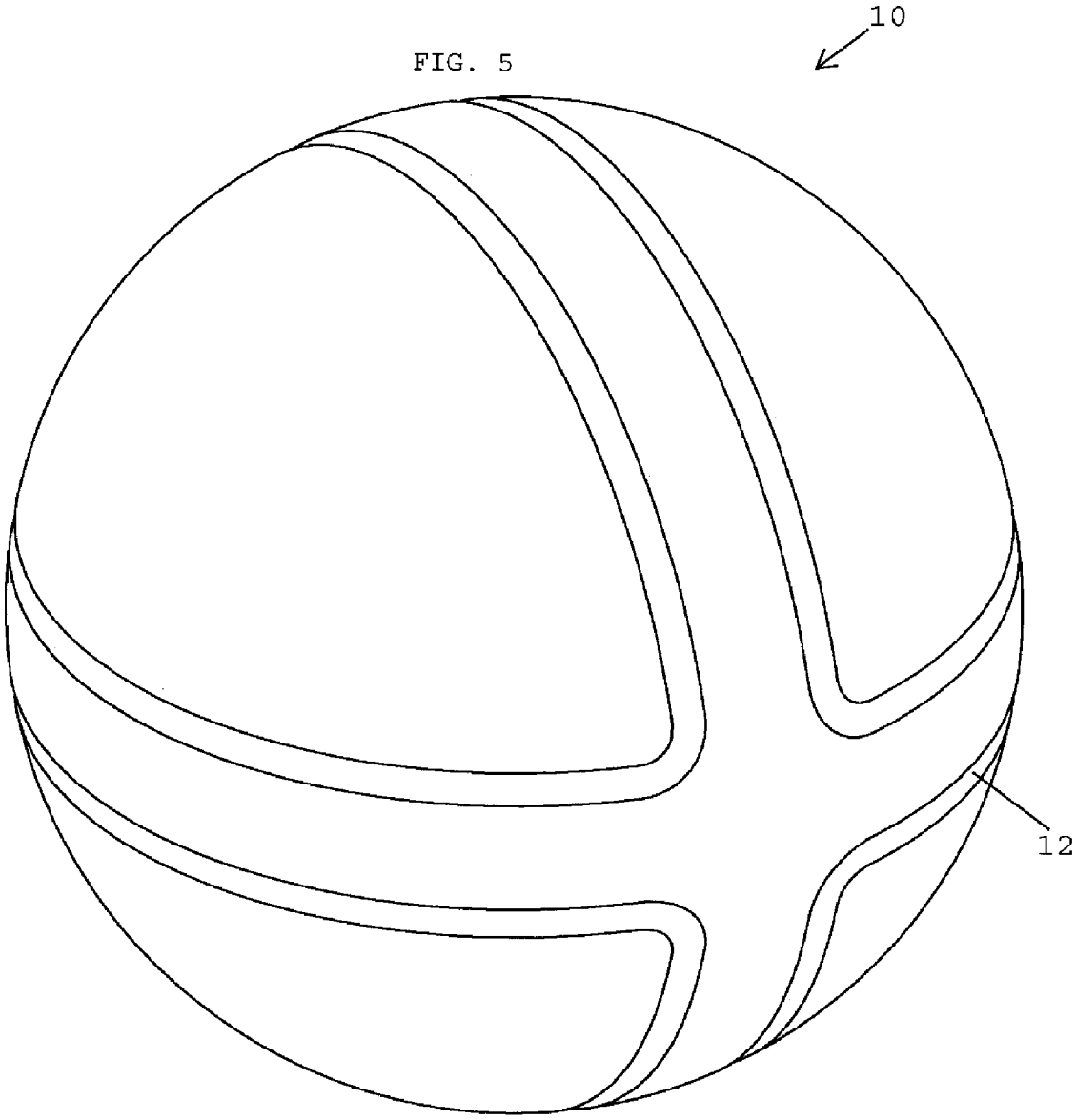
Figure 6:
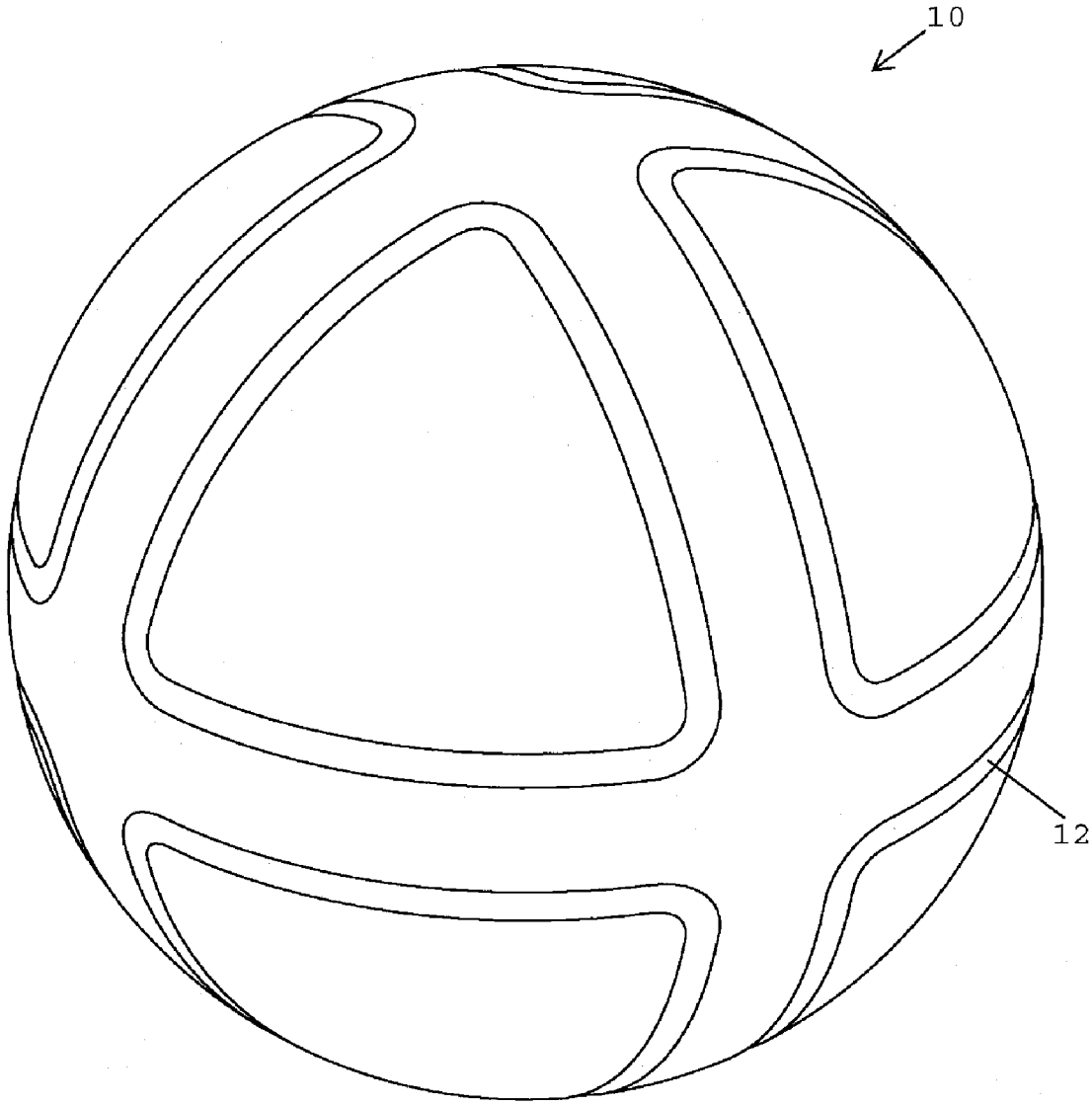
Figure 7A:
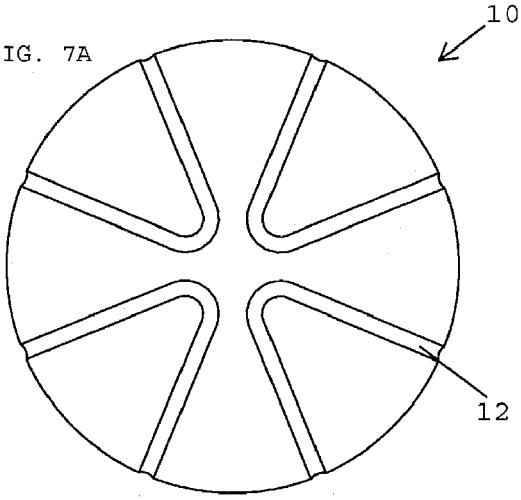
Figure 7B:
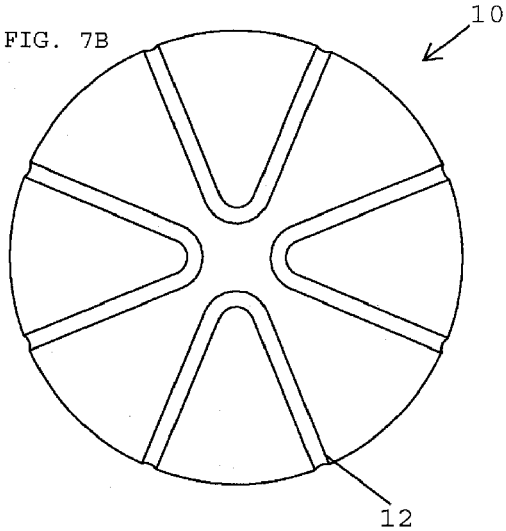
Figure 7C:
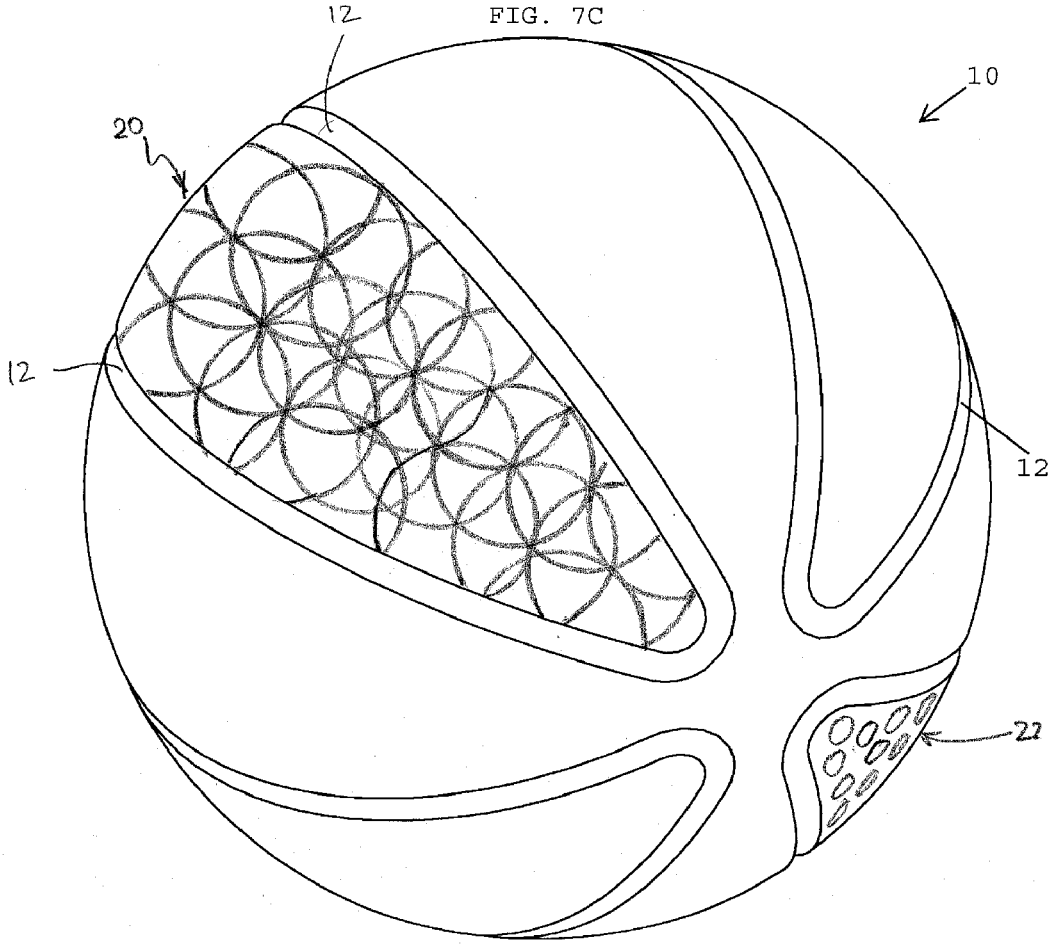
Figure 8:
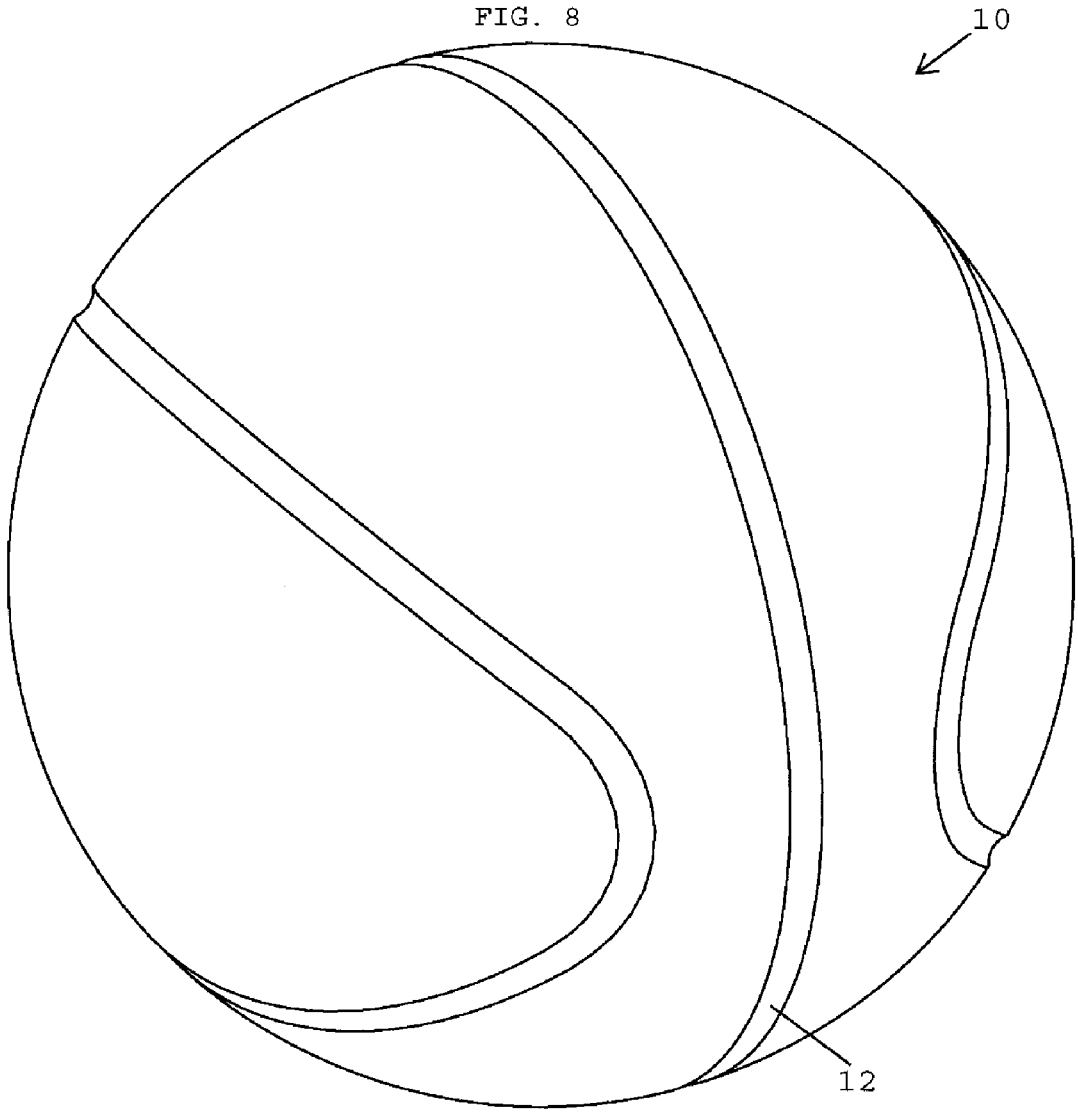
Figure 9:
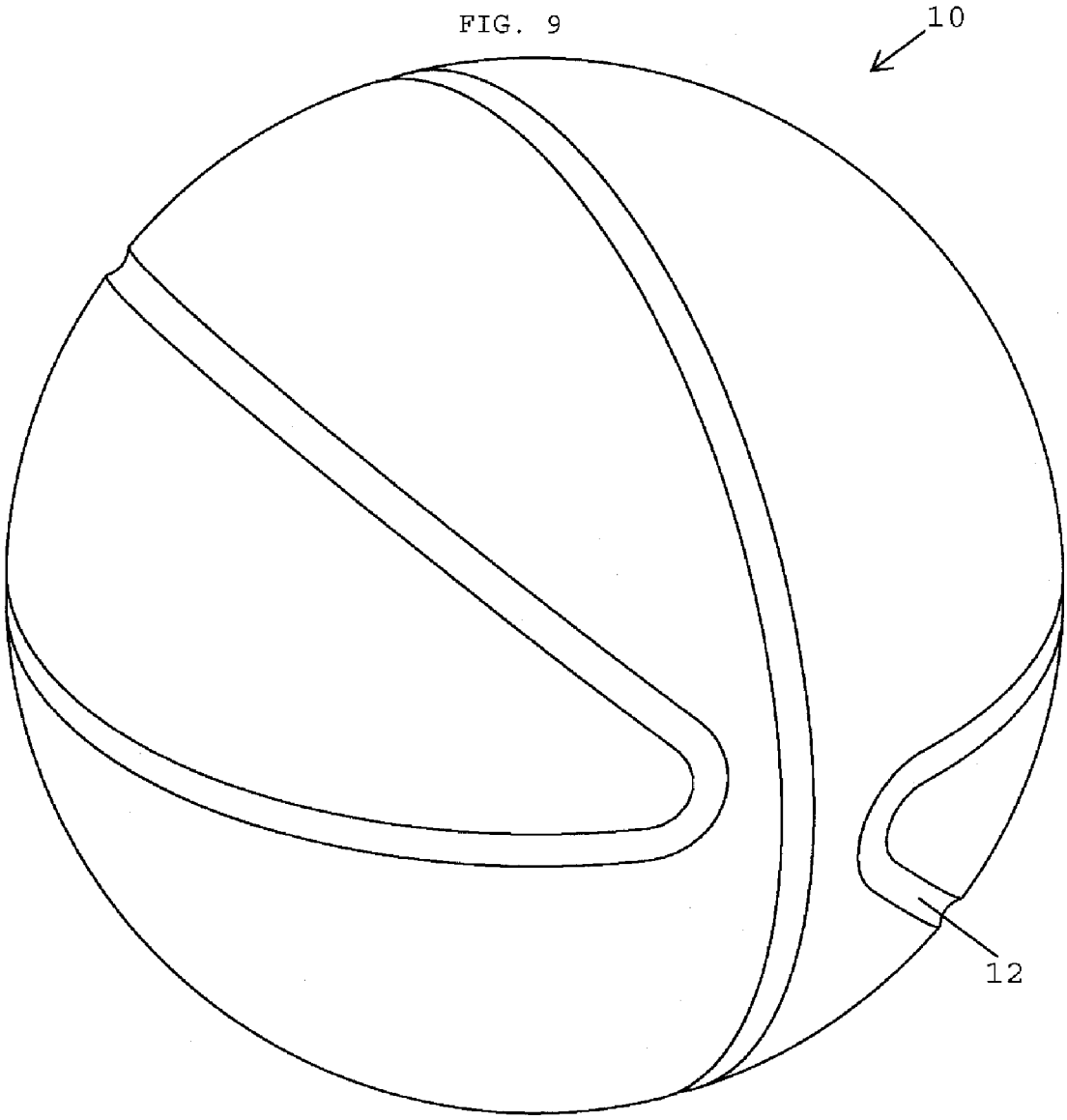
Figure 10A:
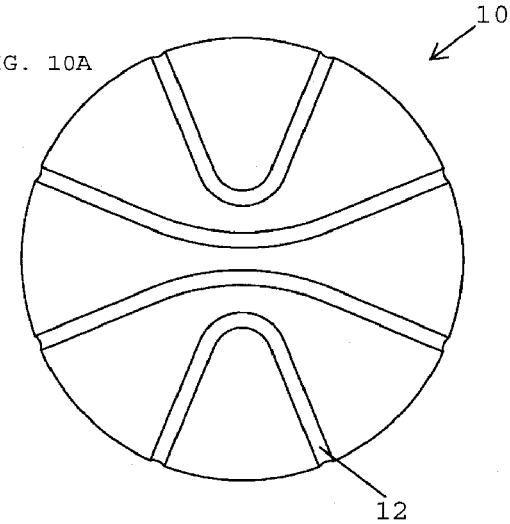
Figure 10B:
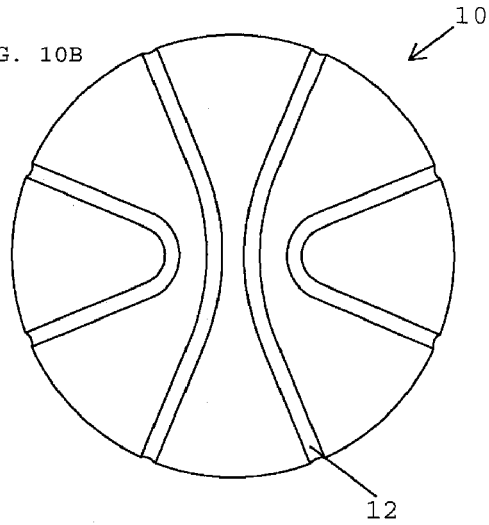
Figure 10C:
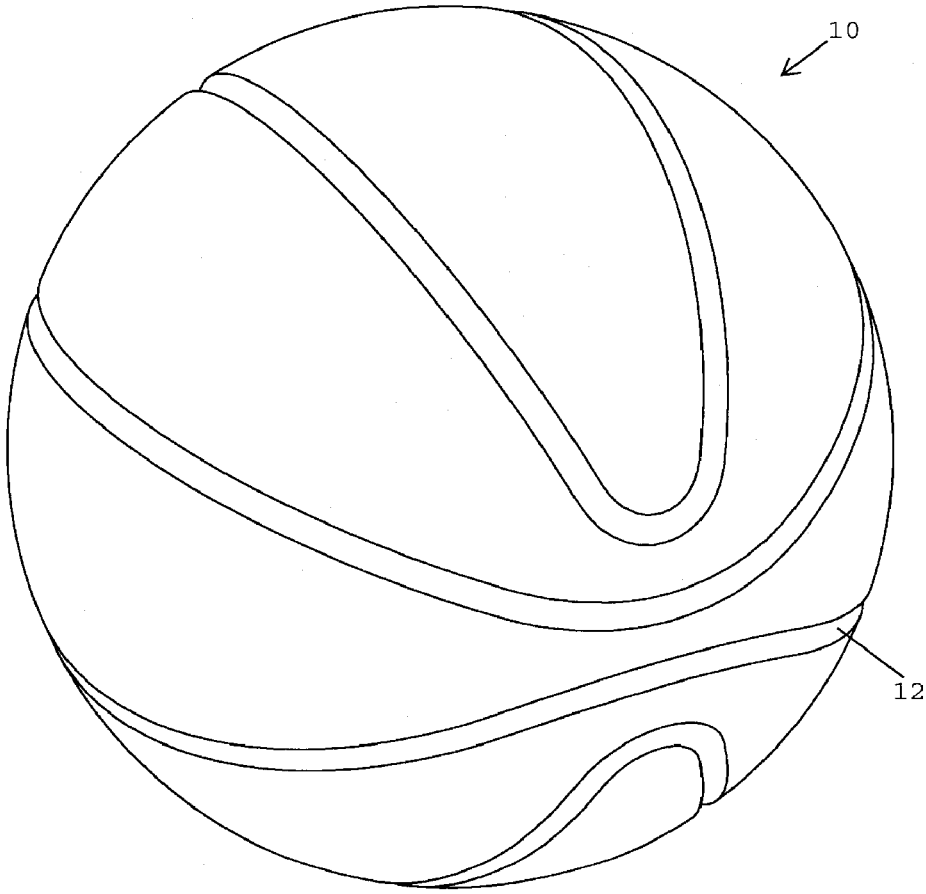
Figure 11:
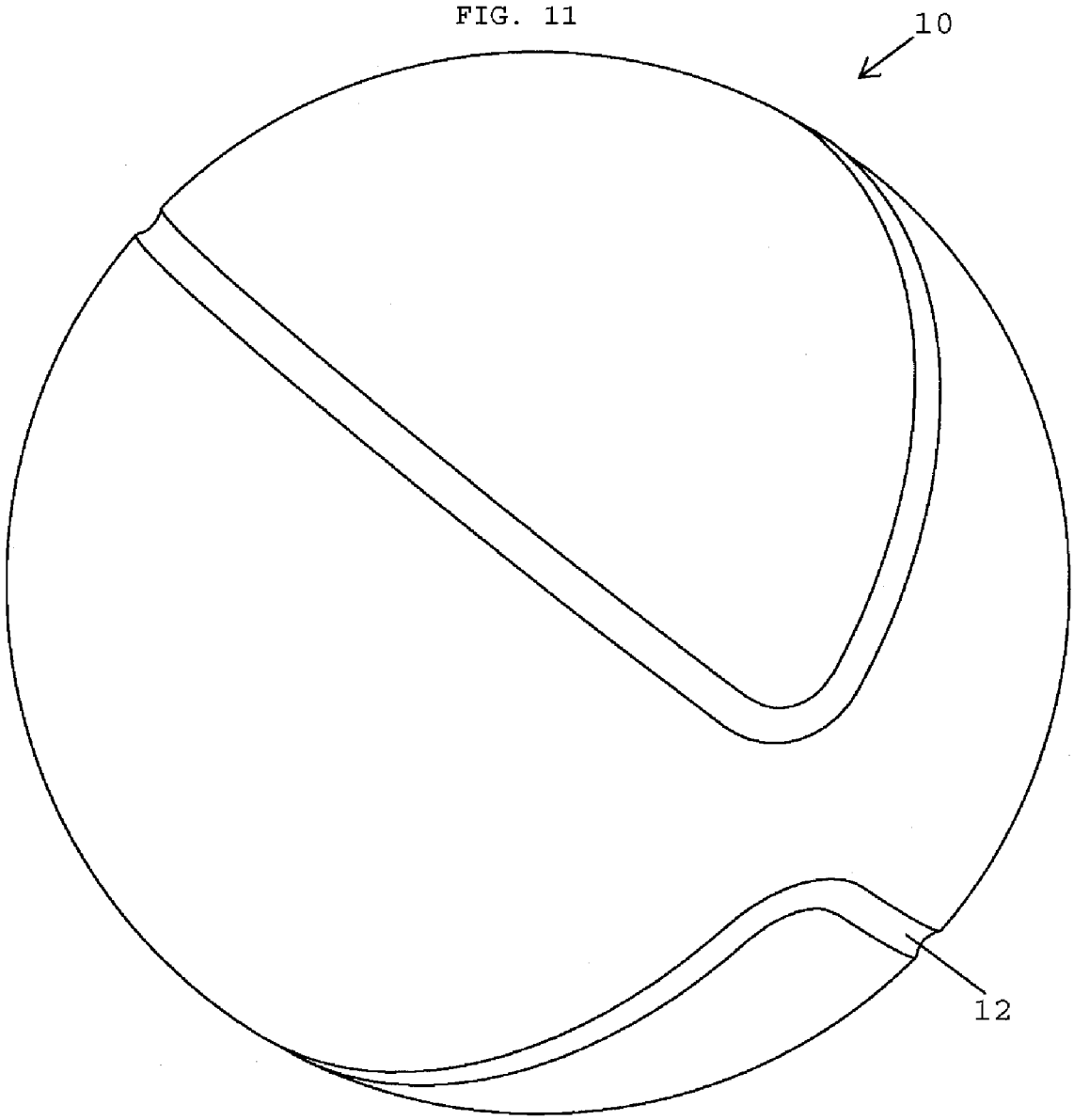
Figure 12:
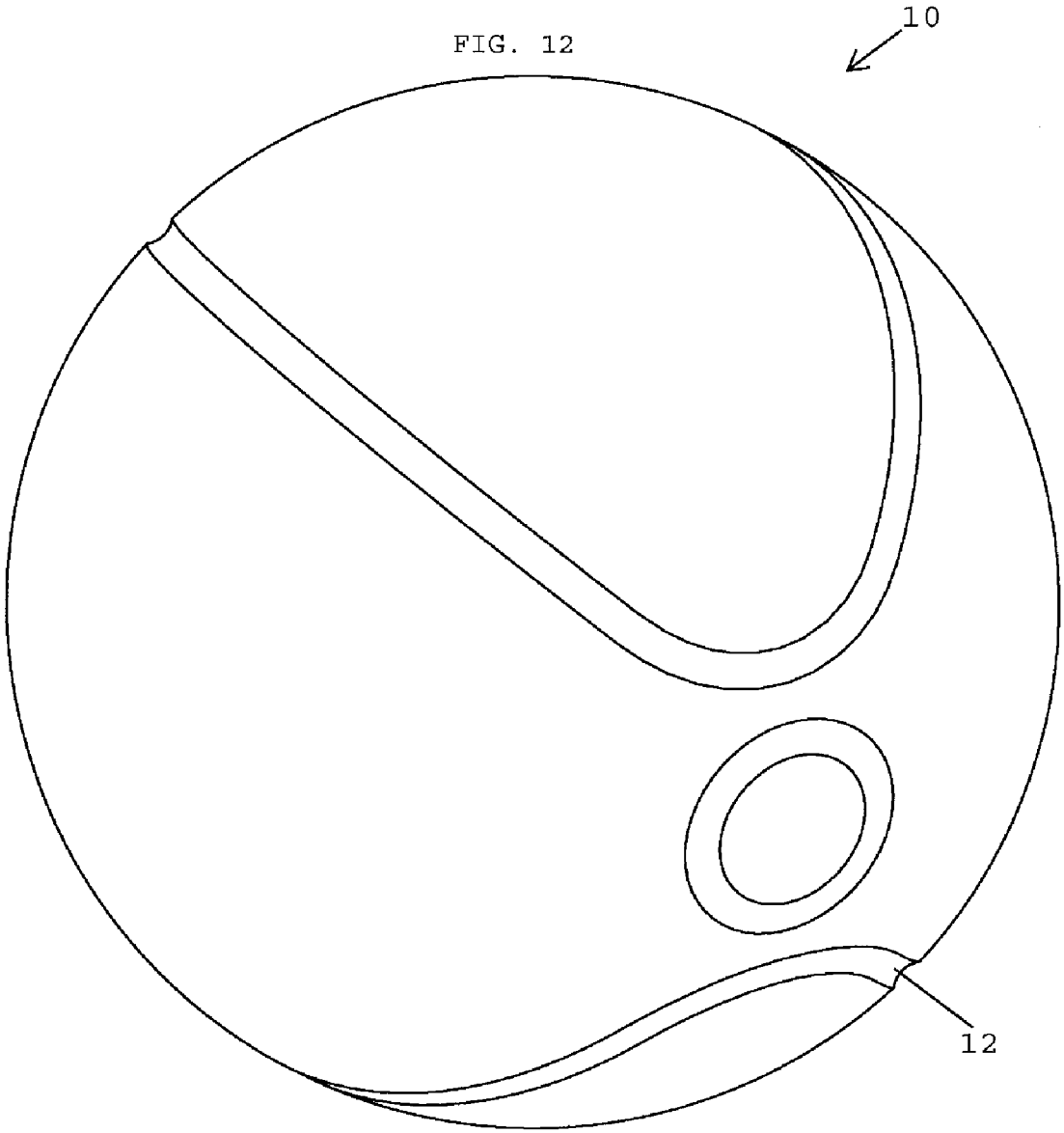

Hence, the golfer may choose orientations 14 or 16/18 to tee the ball as playing conditions dictate. For example, when teeing into the wind a low trajectory using orientation 16 or 18 is preferred and teeing with the wind a high trajectory using orientation 14 is preferred. Similar orientations are shown in FIG. 2. Orientation dependent golf balls offer advantages in recreational non-tournament golf where it is not required to play a ball that conforms to USGA or R&A standards.

In cases where USGA or R&A standards are in force, it may be required to use a ball that flies essentially the same regardless of orientation. Accordingly, the orientation-specific aerodynamic properties produced by channels could actually be used to reduce a ball's tendency to fly differently in different orientations. Often, golf balls without channels will display orientation-specific flight characteristics due to a lack of symmetry in the arrangement of dimples, or as a result of artifacts of the manufacturing process such as seam buffing, or for other reasons. In such cases the orientation-specific properties of a system of channels could be used to partially or fully cancel those effects and make a ball that is less affected by orientation.

Figure 17:
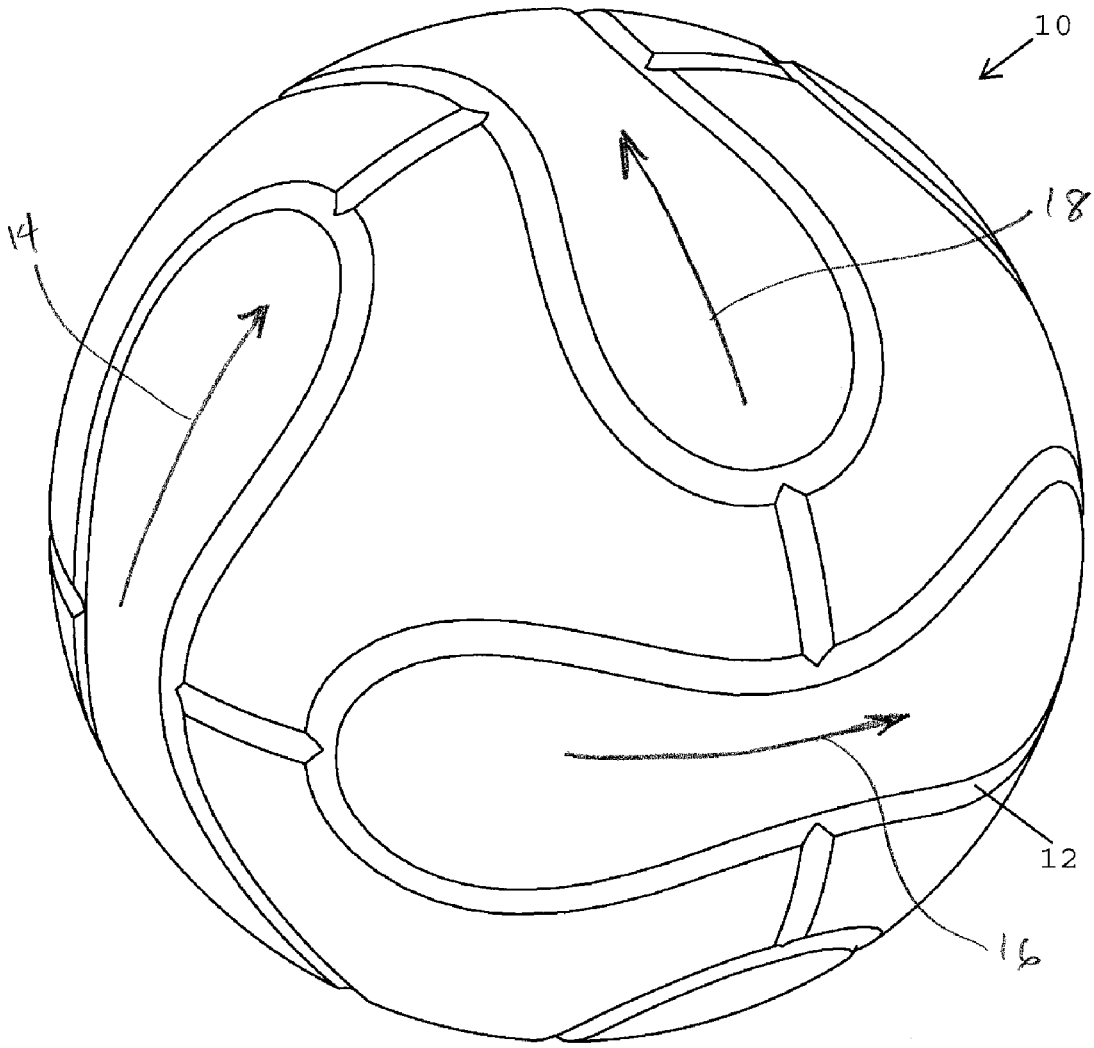
Figure 18:
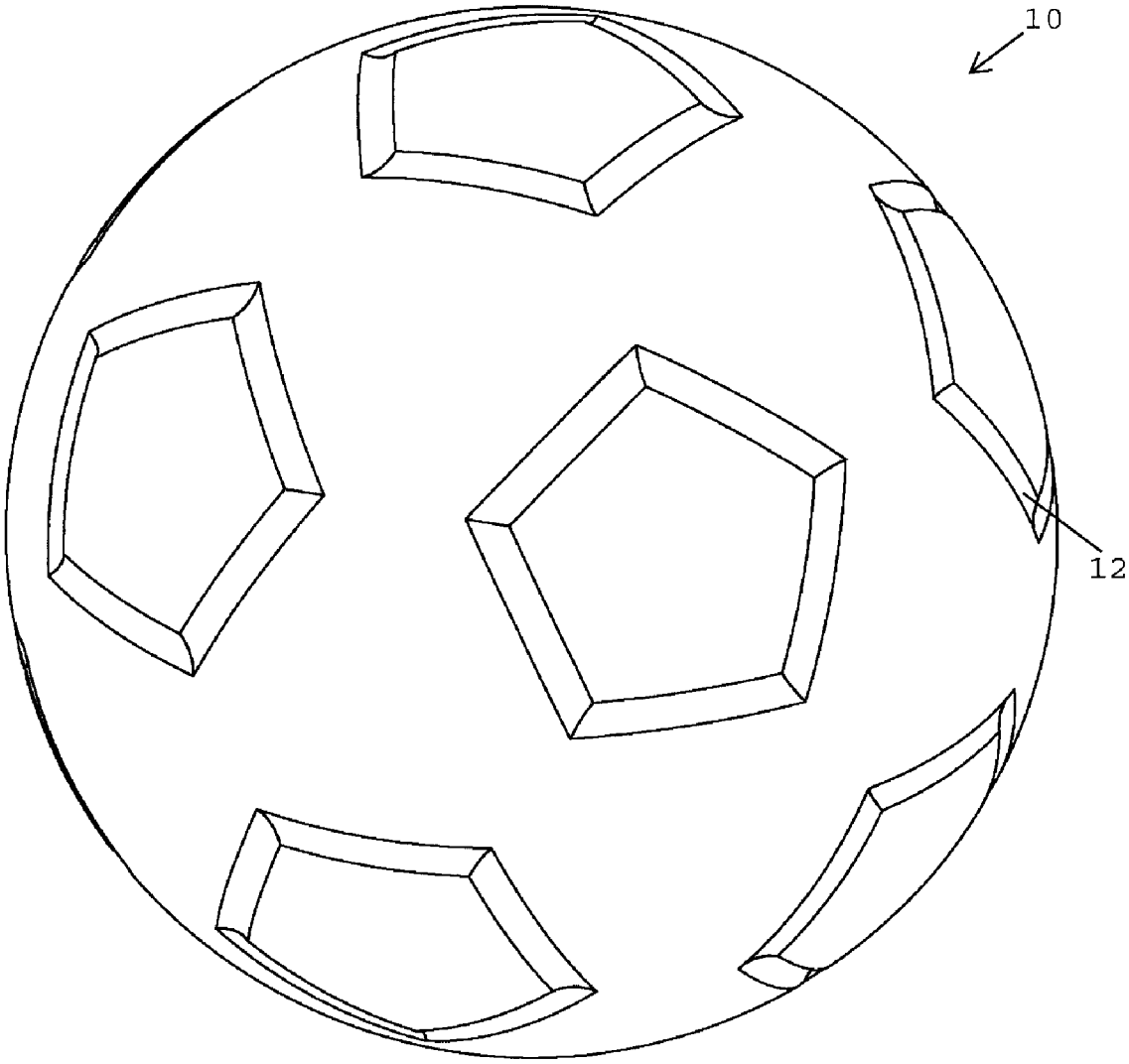
Figure 19:
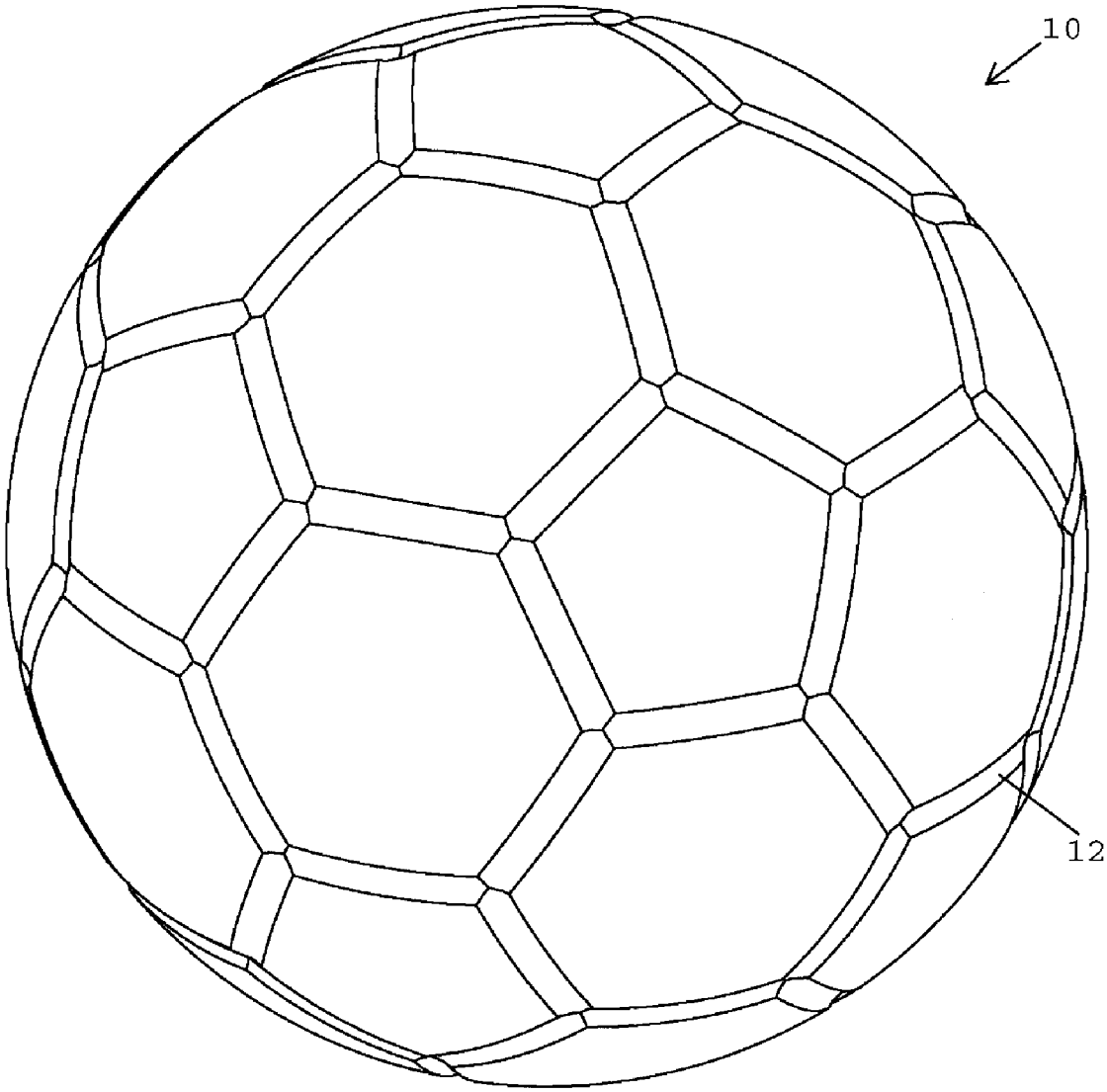

On the other hand, the embodiments shown in FIGS. 6, 13A-13C and 16-19 provide airflow over the balls that are less orientation dependent due to the more symmetric distribution of channels 12. For example, ball 10 in FIG. 17 would have the same aerodynamic characteristics if it was oriented along arrow 14, 16, or 18, as illustrated in FIG. 17.

The channels of the present invention can be used to produce golf balls having unique or specific appearances, such as the appearances of balls used in other sports, such as baseball or tennis (FIGS. 13A-13C), volleyball (FIG. 16), or soccer (FIGS. 18-19), or other non-traditional appearances that enhance their consumer appeal.

In some embodiments, it may be desirable to include dimples, bumps, or other surface textures on the golf ball surface in addition to the channels. The dimples may be circular, or may have non-circular perimeters such as oval, hour-glass shape, regular and irregular polygons. Accordingly, the dimples may be triangular, rectangular, pentagonal, hexagonal, or any other suitable polygonal shape or non-polygonal shapes, or may have polygonal and non-polygonal portions. Another advantage of the present invention is that channels 12 provide more efficient demarcation lines or groupings of non-traditional dimples. Exemplary non-traditional dimples include the surface textures disclosed in parent application Ser. No. 11/025,952, previously incorporated by reference in its entirety. In one example, the surface pattern shown in FIGS. 3 and 4 of patent '952 application is added to a portion of ball 10, illustrated in FIG. 7C at grouping 20. All surface patterns disclosed in this parent application can be used in the present invention. This pattern may be added to all the areas not covered by channels 12, or combinations of distinct patterns can be used. Traditional circular dimples can also be used, as shown in grouping 22. Non-traditional dimples such as figure-eight or barbell dimples can be used as well.

The channels are combined with dimples to increase the percentage of golf ball surface covered in dimples and channels to a level comparable to or greater than traditional golf balls. In one example, the surface coverage of channels 12 is in between about 5% to about 40% and the dimple coverage can be from about 40% to about 90%, with a total dimple/channel coverage ranging from about 60% to 95%. More preferably, the total dimple/channel coverage ranges from about 70% to 90%, and most preferably from about 75% to 85%. Theoretically the total coverage could reach virtually 100%, but this is likely to cause durability issues without producing any performance benefit.

In other embodiments, the channels are replaced with raised ridges. These ridges serve the same purposes as the channels, but may perturb the boundary layer in different, beneficial ways that may make ridges more useful for some of the purposes.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A golf ball comprising an outer land surface and a channel system comprising multiple non-intersecting channels defined on the land surface, wherein at least one of the multiple non-intersecting channels is continuous, the channel system covers from about 5% to about 40% of the outer land surface, the edge angle of the channel system ranges from about 16° to about 90°, and the outer land surface further comprises a plurality of dimples and the dimples cover about 40% to about 90% of the outer land surface.

2. The golf ball of claim 1, wherein the channel system and the dimples cover about 60% to about 95% of the outer land surface.

3. The golf ball of claim 2, wherein the channel system and the dimples cover about 70% to about 90% of the outer land surface.

4. The golf ball of claim 3, wherein the channel system and the dimples cover about 75% to about 85% of the outer land surface.

5. The golf ball of claim 1, wherein the channel system covers from about 5% to about 20% of the outer land surface.

6. The golf ball of claim 5, wherein the channel system covers from about 5% to about 10% of the outer land surface.

7. The golf ball of claim 1, wherein the dimples comprise circular dimples.

8. The golf ball of claim 1, wherein the dimples comprise non-circular dimples.

9. The golf ball of claim 1, wherein the edge angle of the channel system is greater than the edge angle of the dimples.

10. The golf ball of claim 1, wherein the aerodynamic property of the ball is dependent on the orientation or spin axis of the ball.

11. The golf ball of claim 10, wherein the golf ball has a first orientation producing a peak trajectory height difference of at least 10% when compared to a second orientation, when launched at an initial speed of about 235 ft/sec, a launch angle of about 9.5°, and a backspin rate of about 3,000 rpm.

12. The golf ball of claim 11, wherein the golf ball has a third orientation producing a peak trajectory height difference of at least about 10% when compared to the second orientation, when launched at an initial speed of about 235 ft/sec, a launch angle of about 9.5°, and a backspin rate of about 3,000 rpm.

13. The golf ball of claim 1, wherein the aerodynamic property of the ball is dependent on the orientation or spin axis of the ball.

14. The golf ball of claim 13, wherein the golf ball has a first orientation producing a peak trajectory height difference of at least 10% when compared to a second orientation, when launched at an initial speed of about 235 ft/sec, a launch angle of about 9.5° , and a backspin rate of about 3,000 rpm.

15. The golf ball of claim 14, wherein the golf ball has a third orientation producing a peak trajectory height difference of at least about 10% when compared to the second orientation, when launched at an initial speed of about 235 ft/sec, a launch angle of about 9.5°, and a backspin rate of about 3,000 rpm.

16. The golf ball of claim 1, wherein the edge angle ranges from about 18° to about 40°.

17. The golf ball of claim 16, wherein the edge angle ranges from about 20° to about 30°.

* * * * *